United States Patent [19]

Willems et al.

[11] 4,038,083

[45] July 26, 1977

[54] PHOTOTHERMOGRAPHIC RECORDING SHEET

[75] Inventors: Jozef Frans Willems, Wilrijk; Antoon Leon Vandenberghe, Hove, both of Belgium

[73] Assignee: AGFA-GEVAERT N.V., Mortsel, Belgium

[21] Appl. No.: 537,763

[22] Filed: Dec. 31, 1974

Related U.S. Application Data

[63] Continuation of Ser. No. 319,773, Dec. 29, 1972, abandoned.

[30] Foreign Application Priority Data

Apr. 27, 1972 Germany ..... 2220618

[51] Int. Cl.[2] ..... G03C 1/02

[52] U.S. Cl. ..... 96/94 R; 427/261

[58] Field of Search ..... 96/114.1, 94, 64, 85; 427/261

[56] References Cited

U.S. PATENT DOCUMENTS

| | | | |
|---|---|---|---|
| 3,460,946 | 8/1969 | Puerokhauer et al. | 96/94 |
| 3,589,901 | 6/1971 | Lyons | 96/64 |
| 3,816,132 | 6/1974 | Takegawa et al. | 96/114.1 |
| 3,844,797 | 10/1974 | Willems et al. | 96/114.1 |

*Primary Examiner*—David Klein
*Assistant Examiner*—John L. Goodrow
*Attorney, Agent, or Firm*—William J. Daniel

[57] ABSTRACT

Image-receiving material for the production of photographic copies in a dry manner with a layer containing a nonlight-sensitive silver salt and a phthalazinone compound corresponding to the following general formula :

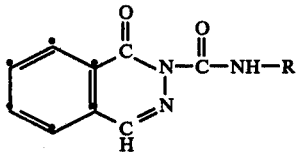

wherein :

R represents 1. an aliphatic group including a cycloaliphatic group and such groups in substituted form,
2. an aryl group including a substituted aryl group,
3. a heterocyclic group including a substituted heterocyclic group, or
4. an acyl group.

7 Claims, No Drawings

PHOTOTHERMOGRAPHIC RECORDING SHEET

This is a continuation of Ser. No. 319,773, filed Dec. 29, 1972, now abandoned. Another related case is Ser. No. 319,604, filed Dec. 29, 1972, now U.S. Pat. No. 3,844,797.

The invention relates to a photographic material for the production of photographic copies in a dry manner, the photographic material comprising toning agents for the formation of black silver images. The invention also relates to a photographic heat copying process, wherein the formation of the silver image is performed in the presence of toning agents that shift the image tone from yellow to black-brown and black.

From the German Pat. No. 888,045 filed June 28, 1943 by Farbenfabriken Bayer a heat development process is known, in which the light-sensitive silver halide emulsion layers comprising a developing agent after having been exposed while heated are developed image-wise without the use of developing baths. As developing agents to be added to heat-developable silver halide layers hydroquinone, pyrocatechol, aminophenol, phenylenediamine, pyrazolidin-3-one and 8-hydroxyquinoline derivatives have been described. Such heat-developable silver halide layers have to be fixed or stabilized so as to avoid a higher colouration of the image background by the influence of light.

Methods, according to which a fully dry processing is performed without processing baths are known also, i.a. all thermographic copying processes such as the process described e.g. in the published German Pat. application No. 1,193,971 filed June 27, 1957 by Minnesota Mining & Manufacturing Co. According to this process a heat-sensitive layer containing a noble metal salt of an organic acid as well as a reducing agent for the noble metal salt is used, a record being obtained therewith by the reduction to a free metal brought about by the image-wise action of heat. Preferably silver salts of long chain organic fatty acids and cyclic organic reducing agents with active hydrogen atoms linked via an oxygen, nitrogen or carbon atom are used. Such layers are insensitive, however, to visible light.

A heat-developable copying material containing these compounds is suited for the thermographic copying of originals containing infrared-absorbing image markings. When the original is exposed to infrared radiation while in contact with such a copying material, the infrared-absorbing image areas of the original are heated selectively and by the heat transfer to the adjacent heat-developable material a silver image corresponding to the image markings of the original is formed.

According to another recording and reproduction process an organic reducing compound incorporated in a light-sensitive copying material is first rendered inactive and non-diffusing by the influence of heat as a result of the image-wise exposure in the presence of a compound that contributes to the inactivation of the reducing compound. The reducing compound still remaining in the unexposed or less exposed areas is then transferred by heat to an image-receiving layer, where it brings about a colour formation.

In these processes only yellow to light-brown silver images of low contrast are obtained, unless suitable measures are taken. A better contrast can be obtained with increasing amounts of reducing agent in the materials used. However, this measure has the following drawbacks:

The amount of the volatile reducing agent present in the light-sensitive material has to be restricted to a minimum, when the exposure time has to be short. The amount of the reducing agent present in the non-light-sensitive image-receiving material has to be as low as possible, so as to avoid any undesired darkening of the coating solution for these layers or of the layers themselves, i.e. to avoid the reduction of the organic silver salts during the manufacture and the storage of the material. Therefore, weak reducing agents of the type of the ortho-alkyl-substituted phenols as described e.g. in the published German Pat. application No. 1,250,842 filed Nov. 21, 1963 by Minnesota Mining & Manufacturing Co. for the non-light-sensitive image-receiving material, are added preferably. The extent of the reduction occurring in the image-receiving material during the image formation is limited therefore.

It is known to add so-called toning agents shifting the image tone to brown and black to the image-receiving layers in order to obtain images having a sufficient optical density and a sufficient contrast in the finished copy. Such compounds are e.g. 2H-phthalazinone-(1), barbituric acid, saccharine, and 2-mercaptobenzoxazole as well as 2-acyl-2H-phthalazinone-(1). In most cases, however, the action of these toning agents is insufficient. With certain compounds of this type the development is inhibited or the image background areas of the image-receiving material change colour during supply of heat so that they have but a limited utility.

It is the object of the present invention to provide toning agents for the photographic processes described above, which toning agents shift the image tone of the silver image to black without impairing the stability of the material as a result of darkening during the manufacture or the storage of this material.

There has been found now a non-light-sensitive image-receiving material for the production of photographic copies in a dry manner with a layer containing a non-light-sensitive reducible silver salt and a compound corresponding to the following general formula:

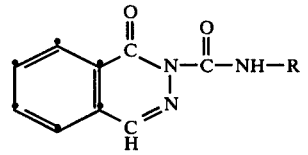

wherein:

R represents (1) an aliphatic group including a cycloaliphatic group and such groups in substituted form e.g. an alkyl group having a straight carbon chain or branched chain structure including a substituted alkyl group e.g. an alkoxy-substituted alkyl group, an alkoxycarbonyl-substituted alkyl group e.g. a carbethoxymethyl group, preferably a $C_1$–$C_{18}$ alkyl group e.g. methyl, ethyl, n-propyl, isopropyl, hexyl, dodecyl, or octadecyl, an alkenyl group including a substituted alkenyl group e.g. an allyl group, a cycloalkyl group including a substituted cycloalkyl group e.g. a cyclopentyl, cyclohexyl, or methylcyclohexyl group, an aralkyl group including a substituted aralkyl group e.g. a benzyl group or phenethyl group, 2. an aryl group including a substituted aryl group, e.g. a phenyl group, a naphthyl group, or a biphenyl group including these groups in substituted form, e.g. a halogen-substituted phenyl group such as 4-chloro-phenyl and 3,4-chlorophenyl, alkyl-substituted phenyl e.g. a tolyl group, alkoxy-substituted phenyl, in which the alkyl group of the alkoxy group is e.g. a $C_1$–$C_{18}$ alkyl group, a carboxy-substituted phenyl group, an esterified carboxy-substituted phenyl group e.g. a methoxycarbonyl-substituted phenyl group, a cyano-substituted phenyl group, or a fluorosulfonyl-substituted phenyl group, 3. a heterocyclic group including a substituted heterocyclic group, or 4. an acyl group e.g. an aliphatic or aromatic acyl group derived from a carboxylic or sulphonic acid e.g. acetyl, methylsulphonyl, benzoyl, or phenylsulphonyl.

Suitable examples of such compounds are the following:

| | | Melting point ° C |
|---|---|---|
| 1. | 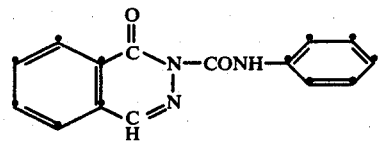 | 154–156 |
| 2. | 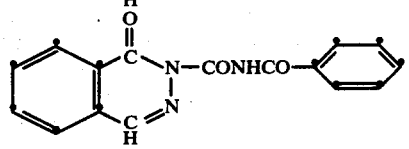 | 179 |
| 3. | 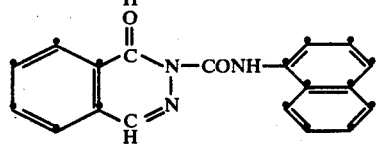 | 168–169 |
| 4. | 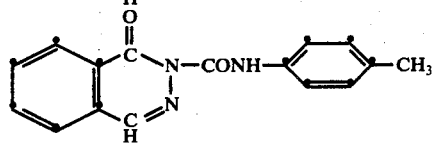 | 140–142 |
| 5. | 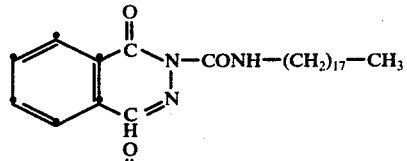 | 71–73 |
| 6. | 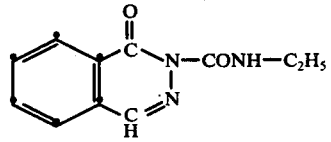 | 116 |
| 7. | 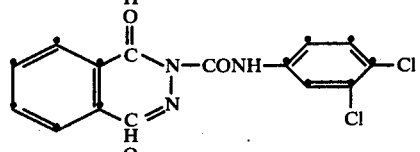 | 182–183 |
| 8. | 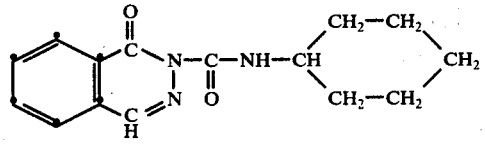 | |

The present invention includes likewise the use of compounds corresponding to the above general formula and containing 2-phthalazinone nuclei, e.g. which in the 2-position are linked by a —CO—NH—X—NH—CO— group, X being a bivalent organic group e.g. alkylene or arylene.

The phthalazinone derivatives of the above general formula are prepared according to known methods e.g. by reaction of phthalazinone with an isocyanate. The preparation of the compounds 1 and 2 is described hereinafter. Other phthalazinones that can be used according to the invention are prepared in an analogous way.

PREPARATION OF COMPOUND 1

A mixture of 146 g (1 mole) of phthalazinone and 138 g (1.1 mole) of phenylisocyanate in 2 l of dry benzene are boiled 4 hours with stirring. The resulting solution is then cooled and the precipitate formed is filtered with suction. The precipitate is then washed with dry diethyl ether.

Yield: 93%.

Melting point: 154°–156° C (decomposition).

PREPARATION OF COMPOUND 2

Within 15 minutes 147 g (1 mole) of benzoylisocyanate are added to 147 g (1 mole) of phthalazinone dissolved in 2 liters of boiling dry toluene. The reaction product precipitates in the boiling solution. This reaction mixture is kept boiling for 1 hour with stirring. Subsequently, the mixture is cooled, whereupon the resulting precipitate is filtered with suction and washed with toluene.

Yield: 85%.

Melting point: 179° C.

The photographic materials of the invention containing a phthalazonine derivative are used in the above described processes for the production of copies in a dry manner.

As a result of the addition of phthalazinone-derivative the image tone of the silver images is shifted as desired from yellowish-brownish to black and blue-black. The stability of the coating solutions for these layers and the stability of the layers themselves is not impaired by the addition of these toning agents. The coating solutions and the layers themselves do not turn brown. Moreover, the photographic properties such as the developability are stabilized surprisingly thereby as compared with the properties of materials comprising no such toning agent. This surprising advantage is observed especially in unfavourable conditions such as increased temperature and relative humidity i.e. in tropical conditions.

The phthalazinone derivatives used according to the invention can be combined also with other known toning agents. The concentration of the additional toning agents is preferably lower than that of the toning agents of the invention.

The photographic materials according to the invention are used in the above described transfer process for the production of positive copies in a dry manner.

In this process for the production of positive copies use is made of light-sensitive materials with a layer comprising a reducing agent that is capable of being transferred at temperatures between approximately 80° and 200° C, and a light-sensitive substance, which at the exposed areas reacts with the reducing agent to form non-transferable products. The exposed layer is then brought in contact with the image-receiving layer of a photographic material containing a non-light-sensitive silver compound. The contacting layers are heated so that the reducing agent is transferred from the unexposed areas of the light-sensitive layer to the image-receiving layer where it reduces the non-light-sensitive silver salt image-wise. A positive image is obtained from the original.

Varying amounts of the phthalazinone derivatives used according to the invention can be added to the layers. The optimum amount depends on the desired effect and on the composition of the layer. It can easily be established by the average technician skilled in the art by making some tests. In general, additions of 0.05 to 4 mole of phthalazinone derivative, preferably of 0.5 to 2 mole per mole of non-light-sensitive silver compound, preferably an organic silver salt, appeared to be sufficient.

The toning agents of the invention can be used in combination with substances and compounds known for the heat transfer process i.e. for the light-sensitive copying material or the heat-sensitive and non-light-sensitive image-receiving material. Such substances and compounds are e.g. reducing agents, binders, silver salts and other heavy metal salts, white pigments, and stabilizing agents.

Such substances or compounds have been described e.g. in the published German Pat. Application Nos. 1,572,209 filed Feb. 2, 1967 by Minnesota Mining & Manufacturing Co., 2,010,822 filed Mar. 7, 1970 by Nashua Corp., 2,010,837 filed Mar. 7, 1970 by Nashua Corp., 2,117,184 filed Apr. 8, 1971 by Nashua Corp., 1,234,243 filed Jan. 2, 1962 by Minnesota Mining & Manufacturing Co., 1,250,842 filed Nov. 21, 1963 by Minnesota Mining & Maufacturing Co., in the U.S. Pat. Nos. 3,074,809 of Richard Owen, issued Jan. 22, 1963 and 3,107,174 of Thomas G. Wartman, issued Oct. 15, 1963, and in the Belgian Pat. No. 766,836 filed May 14, 1970 by Agfa-Gevaert N.V.

Preferably used silver compounds are substantially non-light-sensitive in the conditions of the process of the invention. Such silver compounds are e.g. the silver salts of aliphatic carboxylic acids with a thioether group or silver salts of long chain fatty acids e.g. silver behenate, silver palmitate, and silver stearate and other silver compounds described in the United Kingdom Pat. No. 1,111,492 filed Aug. 13, 1965 by Agfa AG.

Among these silver compounds silver behenate and silver stearate are preferred. Together with free behenic acid and stearic acid they enhance the resistance to moisture of the image-receiving layer.

Compounds to be reduced, which appeared to be suited for the thermically initiated reduction of these silver salts are e.g. pyrogallol, 4-stearoyl-pyrogallol, galloacetophenone, di-tert.butyl pyrogallol, butyl gallate, dodecylgallate, gallic acid, ammonium gallate, 2,5-dihydroxybenzoic acid, $\alpha$- and $\beta$-naphthol, 1-hydroxy-naphthoic acid-(2), phloro-glucinol, pyrocatechol, hydroquinone, 1-phenyl-pyrazolidin-3-one, 4,4'-dihydroxybiphenyl, 1-hydroxy-4-methoxy-naphthalene, 1-hydroxy-4-methoxy-dihydroxy-naphthalene, o- and p-phenylenediamine, and acetoacetonitrile derivatives e.g. according to the U.S. Pat. No. 3,619,239 of Chiaki Osada and Hisatake Ono, issued Nov. 9, 1971 or the published German Pat. Application No. 2,010,837 filed Mar. 7, 1970 by Nashua Corp.

Other reducing agents that are suited for use at increased temperature are pyrazolin-5-one compounds with at least one hydrogen atom in the 4-position. Suitable compounds of this type have been described in the published German Pat. Application No. 2,117,053 filed Apr. 7, 1971 by Agfa-Gevaert N.V.

As appears from the above enumeration these reducing compounds are organic compounds wherein an active hydrogen atom is linked to a carbon, oxygen, or nitrogen atom, which itself is linked to an atom of an aromatic or heterocyclic ring or in the case of the nitrogen atom may also constitute a part of a heterocyclic ring.

Compounds that may contribute to the photo-deactivation of these reducing compounds have been described e.g. in the United Kingdom Pat. No. 1,002,350 filed Jan. 3, 1962 by Minnesota Mining & Manufacturing Co. Particularly suited are halogen-containing fluorescein dyes such as e.g. erythrosin.

In addition to the above reducing agents other compounds can be used, which act as auxiliary reducing agents.

Examples of such compounds are sterically hindered phenols, which participate actively in the reduction reaction when heated e.g. 2,6-ditert.-butyl-4-methylphenol and 2,6-dicyclohexyl-p-cresol.

The image tone and the image density of the image-receiving material can be improved also by the addition of certain metal salts such as e.g. lead (II) stearate. Such metal ion image-improving agents as well as their use have been described in the published German Patent Application No. 1,572,209 filed Feb. 2, 1967 by Minnesota Mining and Manufacturing Co.

Suitable binders for the light-sensitive layer and the image-receiving layer are the usual natural or synthetic film-forming polymers such as proteins, e.g. gelatin, cellulose derivatives such as cellulose ethers, cellulose esters or carboxymethylcellulose, alginic acids and derivatives thereof, starch ethers or gallactomannan, polyvinyl alcohol, polyvinylpyrrolidone, polyvinyl chloride, copolymers of vinyl chloride and vinyl acetate, polyvinyl acetate or wholly or partially saponified polyvinyl acetate and copolymers of vinyl acetate, copolymers of acrylonitrile and acrylamide, polyacrylates, polymethacrylates, polyethylene, etc.

The layers can be used in the form of self-supporting layers or they can be applied to a support. Suitable supports are e.g. paper such as baryta-coated or sized paper, cellulose esters e.g. cellulose triacetate, polyesters e.g. polyethylene terephthalate, glass, etc.

When the binders for the light-sensitive layer and the image-receiving layer are selected, care should be taken that the resulting layers do not stick to each other when heated. However, such difficulties can be solved as known from other processes such as the silver salt diffusion transfer reversal process or the heat-development process and by using the experience gained in other fields.

The layers may comprise white pigments such as zinc oxide, silica, or titanium dioxide as filling agents for the improvement of the white appearance of the image background area and for influencing the stickiness of the layers. Further the terpene resins and organic acids can be added to the layers for improving the keeping properties. Such layers have been described in the U.S. Patent Nos. 3,074,809 of Richard Owen, issued Jan. 22, 1963 and 3,107,174 of Thomas G. Wartman, issued Oct. 15, 1963.

The reactants can also be incorporated in a fibre web in the absence of a binder. In order to obtain special effects pigments, fillers, fusible substances such as e.g. wax, dyes, and various other additives can be incorporated.

The silver salt and the toning agent are mixed preferably before the coating. However, they can also be incorporated separately in adjacent layers, from which the toning agent e.g. during heating of the support, may diffuse to the silver salt.

For the exposure of the light-sensitive layers the light sources known in the reproduction technique can be used, e.g. halogen lamps, iodine-quartz lamps, and incandescent lamps. The spectral sensitivity of the light-sensitive material depends on the nature of the sensitizing dyes used.

The transfer of the image-forming compounds from the unexposed areas of the light-sensitive layers to the image-receiving layer is performed at temperatures between 80° and 200° C. The heating can be performed e.g. by bringing the exposed light-sensitive layer in contact with the image-receiving layer and on heated plates or rollers or by exposing these layers to infrared radiation. The optimum temperature and heating period depend, of course, on the nature of the image-forming compound and the composition of the non-light-sensitive copying material containing the silver salt. They can be established by some simple tests.

EXAMPLE

Manufacture of the image-receiving material

A mixture of the following ingredients is ground for 12 hours in a ball-mill:

| | |
|---|---|
| ethyl acetate | 40 g |
| stearic acid | 0.7 g |
| polyethyl acrylate | 0.6 g |
| cellulose acetobutyrate | 0.2 g |
| compound 1 | 0.4 g |
| zinc oxide having an average grain size of 10 micron | 4.1 g |
| silver stearate | 0.9 g |

Prior to the coating this ground mass is admixed with the following ingredients:

| | |
|---|---|
| ethyl acetate | 20 g |
| acetone | 2.5 g |
| 2,6-di-cyclohexyl-p-cresol | 0.3 g |

The resulting mixture is then applied to a paper support at a ratio of 150 g per sq. m.

Manufacture of the light-sensitive material

A transparent paper is coated with the following mixture at a ratio of 25 g/m2:

| | |
|---|---|
| (p-chlorophenyl)-acetoacetonitrile | 1.0 g |
| erythrosine | 440 mg |

-continued

| | |
|---|---|
| ethylcellulose | 50 g |
| methyl ethyl ketone | 500 g |

The resulting layer is dried as usually.

Processing

The light-sensitive layer is exposed image-wise for 30 sec. by means of a tungsten lamp of 1500 Watt placed at a distance of 5 cm from the light-sensitive material.

The exposed layer is then brought in contact with the image-receiving layer for 5 sec. at 125° C. Blue-black images having a high density are obtained. Equally good results are obtained with compound 2.

We claim:

1. Image-receiving material for the production of photographic copies in a dry manner with a layer containing a non-light-sensitive silver salt and a phthalazinone compound corresponding to the following general formula:

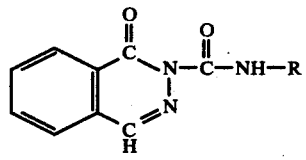

wherein:

R represents $C_{1-18}$ alkyl group or a cyclopentyl or cyclohexyl group, or a phenyl or naphthyl group.

2. Image-receiving material according to claim 1, wherein the image-receiving material contains a silver salt of a fatty acid having at least 14 carbon atoms.

3. Image-receiving material according to claim 2, wherein the image-receiving material contains silver behenate or silver stearate.

4. Image-receiving material according to claim 1, wherein the image-receiving material contains a silver salt of an aliphatic carboxylic acid substituted with a thioether group.

5. Image-receiving material according to claim 1, wherein the image-receiving material contains 0.5 to 4 mole of the phthalazinone compound per mole of silver salt.

6. Image-receiving material according to claim 1, wherein the image-receiving material contains a sterically hindered phenol.

7. Image-receiving material according to claim 6, wherein the sterically hindered phenol is 2,6-di-tert.butyl-4-methyl-phenol or 2,6-di-cyclohexyl-p-cresol.

* * * * *